US005992887A

United States Patent [19]

Maruchi

[11] Patent Number: 5,992,887

[45] Date of Patent: Nov. 30, 1999

[54] BOOK CLASPING AND PAGE MARKING DEVICE

[76] Inventor: William L. Maruchi, Chemin Des Pechuers 10, CH-1166 Perroy, Switzerland

[21] Appl. No.: 08/798,480

[22] Filed: Feb. 10, 1997

Related U.S. Application Data

[63] Continuation of application No. PCT/IB94/00248, Aug. 11, 1994.

[51] Int. Cl.[6] ..... B42D 9/00

[52] U.S. Cl. ..... 281/42; 281/45; 24/67.9

[58] Field of Search ..... 281/42, 45, 51; 24/67 R, 67.3, 67.9

[56] References Cited

U.S. PATENT DOCUMENTS

| | | | |
|---|---|---|---|
| D. 167,016 | 6/1952 | Zaccone . | |
| D. 218,511 | 8/1970 | Sarro . | |
| 231,349 | 8/1880 | Norton . | |
| D. 239,147 | 3/1976 | Karlsen . | |
| D. 301,042 | 5/1989 | Capamaggio . | |
| 400,627 | 4/1889 | Angell . | |
| 521,259 | 6/1894 | Davis . | |
| 609,486 | 8/1898 | Wilson . | |
| 1,710,949 | 4/1929 | Pokora . | |
| 2,661,568 | 12/1953 | Stark et al. . | |
| 2,704,688 | 3/1955 | Adell . | |
| 2,861,309 | 11/1958 | Saviolides | 24/67 R |
| 3,324,823 | 6/1967 | Peters . | |
| 4,382,617 | 5/1983 | Fortier . | |

FOREIGN PATENT DOCUMENTS

| | | |
|---|---|---|
| 530092 | 9/1956 | Canada . |
| 286545 | 10/1988 | European Pat. Off. . |
| 1527582 | 6/1967 | France . |
| 85410 | 6/1895 | Germany . |
| 37 27 762 | 3/1989 | Germany . |
| 593 150 | 11/1977 | Switzerland . |
| 15268 | 4/1913 | United Kingdom . |
| 1410019 | 10/1975 | United Kingdom . |
| WO 88/07451 | of 1988 | WIPO . |

*Primary Examiner*—Willmon Fridie, Jr.
*Attorney, Agent, or Firm*—Merchant & Gould P.C.

[57] ABSTRACT

A book or other document clasping and page marking device (20) is formed as a generally U-shaped clip for passing around and clamping the edges of a set of pages and/or the cover of a book (10). The device consists of a generally U-shaped member of resilient material such as transparent molded plastic material having opposing arms (21, 24) which are normally flat in cross section and flat or curved in longitudinal section. One or both of the inside parts of the opposing arms, away from their junction, has a page-gripping surface which is serrated, grooved, roughened or otherwise treated or coated to lightly but firmly grip the device against a page when the device is clipped on a book, facilitating insertion of a page. The device (20) can be inserted into a selected position of a book edge wherein the joining part of the U and the adjacent parts of the arms of the device can protrude by a desired amount to provide a counter-balancing effect.

12 Claims, 3 Drawing Sheets

BOOK CLASPING AND PAGE MARKING DEVICE

This application is a continuation of PCT/IB94/00248 filed Aug. 11, 1994.

FIELD OF THE INVENTION

The invention relates to a book clasping and page marking device designed to slip into a book, grasp a collection of pages and provide counterweighting to help keep the book in the open position.

BACKGROUND ART

EP-A-286,545 describes a book holder including a flexible backing strip formed to extend along the covers of an open book with ends bent back toward each other to overlap the pages of an open book.

CH-A-593,150 discloses a flat bookmarker with a twistable hook-like end arranged to engage and hold several pages.

GB-A-1,410,019 describes a bookholder and stand which has a back having flat members to clamp the open cover of a book, and a "fence" or rim along the front to restrain the lower parts of the open pages.

Several older patents describe bookmarkers made of wire bent into more-or-less practical and complex shapes. For example, U.S. Pat. No. 1,710,949 describes a braced spring clip of bent wire which clips over open pages and has a projecting page-engaging arm. U.S. Pat. No 2,661,568 discloses a bookholder made of bent spring loops which clip over the top of the book cover, with projections forming an easel on which the book rests. U.S. Pat. No. 4,382,617 describes a combined book leaf holder and bookmark made of a bent wire with a backing loop which engages between the spine of a book, and lateral bent prongs which clip against the facing pages.

WO 88/07451 relates to a page fixing device having two spaced-apart prongs opposite a flat upper face. This device slides over the facing open pages of a book, with the upper face laying on top of the pages and the prongs engaging behind the pages, on either side of the opened book.

These prior book holders and page markers have not found general market favor due to their complex designs, liability to breakage, inconvenience of fitting or removing them, size, material and/or other reasons; such as the risk of ripping pages when the device is placed on a book or removed. Despite attempts for many years, so far there is on the market no satisfactory mass merchandisable book clasping and page marking device which meets the criteria of simplicity of manufacture, inexpensive and easy-to-handle material, robustness, and its convenience and effectiveness of use.

SUMMARY OF THE INVENTION

The invention aims to provide a book clasping and page marking device which is simple to manufacture from lightweight material, is comprehensive, compact and convenient to use, in particular which is easy to fit on and remove from a book while allowing easy insertion of new pages therein while reading without a risk of ripping or damaging either the pages or the cover; is versatile (for multiple sized books) and affordable, and which improves the ease of reading of the book and, importantly, the user's mobility and/or overall convenience while reading.

The book clasping and page marking device according to this invention is characterized by the features set out in the accompanying claims.

The invention as claimed is intended to improve upon existing book or page markers by a unique design that arches the book open, provides counterweighting to help keep the book open and, in addition to its convenient size and shape, has gripping surfaces such as teeth which avoid slippage of the device when it is normally clipped into a book. The most common and practical—though not exclusive—material used is transparent and allows the reader to read text directly through the device with minimal-to-no distortion to the text in any significant portion of the page. The small size easily fits in a pocket or in a convenient corner of a briefcase or handbag/pocket book.

The device slips into a book and grasps a collection of pages—generally up to 100 pages (or 50 sheets of paper) at any time, as a practical maximum, or perhaps more. The device's ability to slide into the book plus its capabilities of gripping a collection of pages serves to provide optimal gripping and the heavier outer edge provides the counterweighting capability to allow maximum freedom of movement by the reader while reading. Examples include: reading while eating, holding open a cook book while preparing a recipe, or holding reading material for a flying business traveler who may be snacking and taking notes simultaneously in a limited space; taking notes while working on a PC, holding open pages of a musical score while playing an instrument, among many other examples.

The book clasping and page marking device of this invention provides greater mobility for the reader which is achieved by the combination of shape, weight, gripping, marking of pages, and minimal text distortion. The reader's hand or hands can be left free for any other activity. For handicapped people, the device can provide practical assistance.

The book clasping and page marking device, for either larger hardback or a variety of sizes of paperback books and other documents, consists of a flexible page holding device which can be moved cut-of or into the book depending upon the counter-balancing weight necessary to keep the book in the open position. When the book is manually closed, the device also preserves the page where the reader decided the page should be preserved, with no supplemental positioning required. The device largely enables a reader to use no hands to read, with the exception of turning pages which easily slide into the device and can be done with one hand, or occasionally manually opening the book to the open position.

The design as depicted in the accompanying drawings, has a heavier outer edge for counterbalancing the book's natural tendency to close itself, combined with a clasping and generally rectangular top and bottom portion which serve to grip the page or collection of pages.

The top, bottom and outer edge portions of the device could be any shape or color, and made of any suitable flexible material. Regardless of the device's shape, color or material, the reader will have to manually fully open the book from time to time and will normally move the edge of the device closest to the cover of the book further into the book as reading progresses.

The device is optimally designed to facilitate keeping a book open, and to easily allow the closure and storage of the book with minimal stress to either the book or the device. The top and bottom portions of the device are each of sufficient length to allow for the range of normal book sizes and counterbalancing requirements to keep the book or most other documents open, and may be of similar length and width, though either the top or bottom portion could be longer than the other portion, or could be wider or shaped differently.

The device also has gripping teeth or other non-skid-designed material (i.e. rough surfaced plastic or other surface treatment or coating material) on at least one edge, which allows the page to slide into the device but grips the page and restrains it from readily sliding out. For example, one or both of the facing page-engaging surfaces of the arms have a specially shaped page-gripping profile/treatment such as asymmetric ridges or the like.

DESCRIPTION OF PREFERRED EMBODIMENTS

Figure 1:
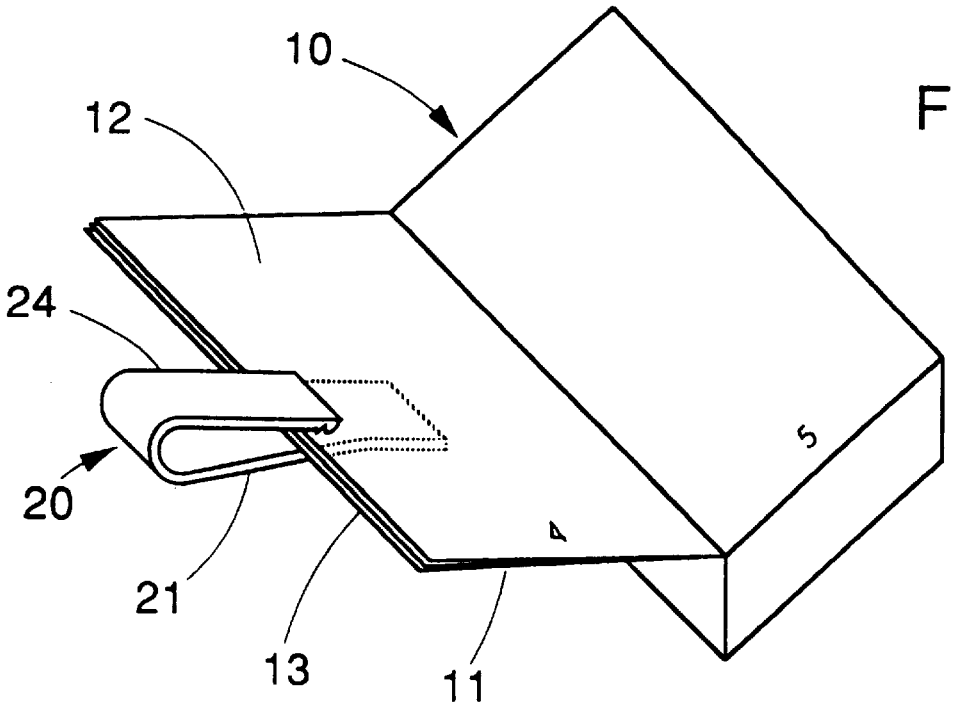
FIG. 1 is a perspective view showing a device according to the invention clipping a few pages of an open book, with the device in a pulled-out position.
Figure 4:
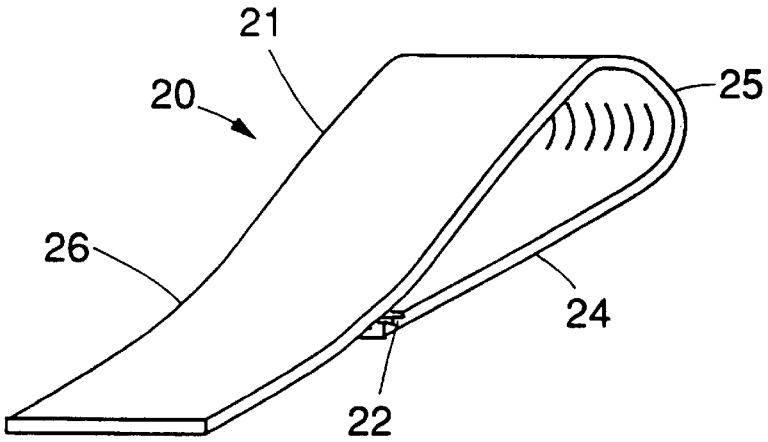
FIG. 4 is a perspective view of one embodiment of a device according to the invention.

FIG. 1 shows the most common usage methodology for reading a book 10 with a device 20 of the type shown in FIG. 4. The longer, arched section 21 of the device presses against the front cover 11 of the book during the early stages of reading while the shorter side 24 with gripping teeth presses against the opened page 12 thereby clasping the pages together. In this early reading stage, the device 20 is pulled more-or-less three-quarters of the way to the outside edge 13 of the book to add counterbalancing weight to keep the book open. The combined longer cover side, arched shape and shorter page side serve to arch the book into the open position.

Figure 2:
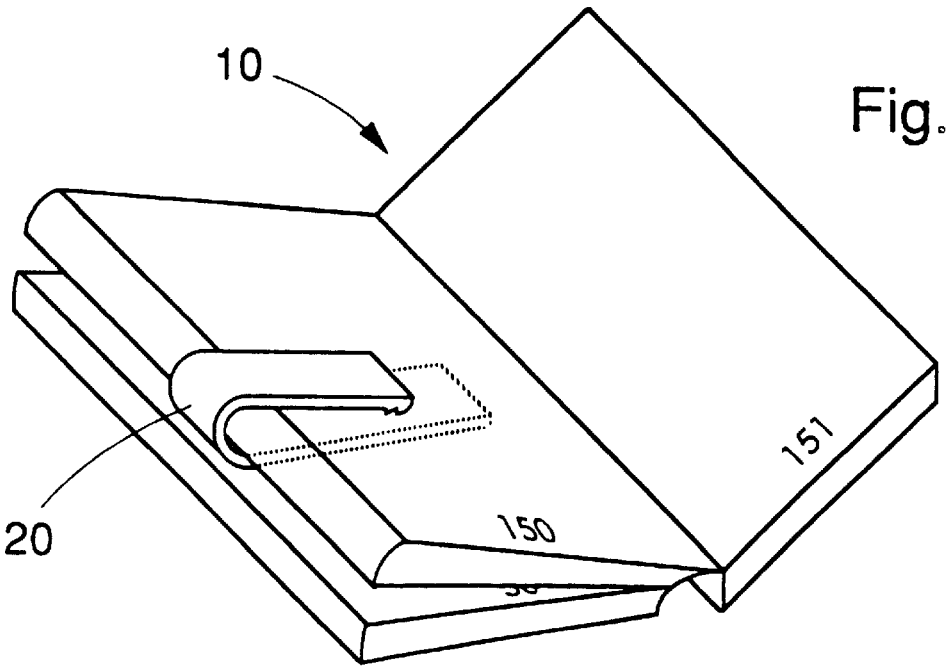
FIG. 2 is a view similar to FIG. 1 with the device in a pushed-in position clasping more pages of the open book.

FIG. 2 shows that, as reading progresses and a number of pages are clasped together, the device 20 can be inserted further into the book 10.

Towards the end of the book, the same progressive system is followed, or the reader can reverse the device to grasp from the back cover of the book.

When the book is closed, the reader can leave the device either horizontally or vertically gripping a collection of pages and preserving the desired page to which to return.

Figure 3A:
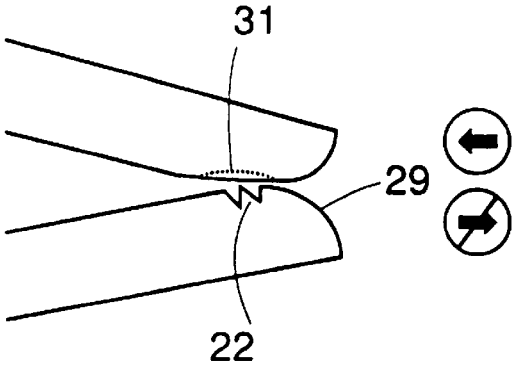
FIGS. 3*a* and 3*b* are schematic views showing examples of facing gripping surfaces of the device.
Figure 3B:
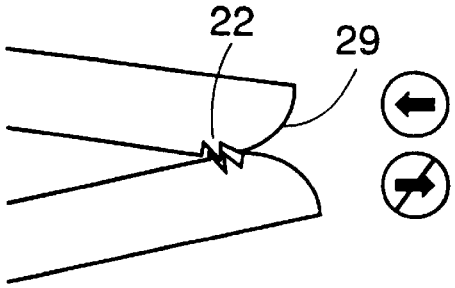

The page-engaging or clasping surface(s) of the arm(s) has/have a page-gripping profile designed to ease insertion of pages into the U-shaped or rounded member and to restrain removal of pages from the U-shaped or rounded member. FIGS. 3*a* and 3*b* show details of such gripping teeth 22, which may be provided on one or both sides of the device. The teeth 22 on the cover side of the book being read can point in either direction.

The inside part of the end of at least one of the arms has a rounded section 29 which flares outwardly and upwardly to facilitate the insertion of pages between the arms.

As shown in dotted lines in FIG. 3*a*, opposite the gripping teeth 22 on one arm, the other arm is advantageously provided with a corresponding recess 31 which receives the gripping teeth 22 and which encourages the two arms to provide optimal gripping pressure. This is particularly advantageous when the device is molded from resilient plastics material, and it ensures firmer gripping after molding. Moreover, by means of this recess 31 cooperating with the gripping teeth 22, the device can grip firmly on only a few sheets, or even on a single page of a "normal" book (page thicknesses have a wide variance).

The gripping effect is sufficient to hold the device 20 in place on book 10, e.g. as shown in FIG. 1, without sliding on the page and while allowing easy insertion of new pages and preventing the inserted pages from moving out or inadvertently being pulled out. In case of an abrupt force acting, the device is able to slip without ripping or ruffling the pages.

The device 20 shown in FIG. 4 consists of a rounded generally U-shaped clip member or backing, preferably made of transparent molded plastics material, which has unequal arms connected by a continuous rounded connecting part 25. The page facing arm 24 is flat in cross-section for the read-through" portion i.e. across a page for ensuring a good, even contact. In longitudinal section, arm 24 is flat and arm 21 is curved. This arm 24 is about two thirds as long as arm 21 and its free page-facing end is provided with a gripping surface 22 pressing toward a slightly concave intermediate part 26 of the long arm 21.

This arched design facilitates the curving back of the pages of the book 10 towards the natural curvature of a book being read. The same effect can also be achieved with other designs. The arched design also encourages the page being read to be as close to the plastic as possible to provide minimal text distortion.

Figure 4A:
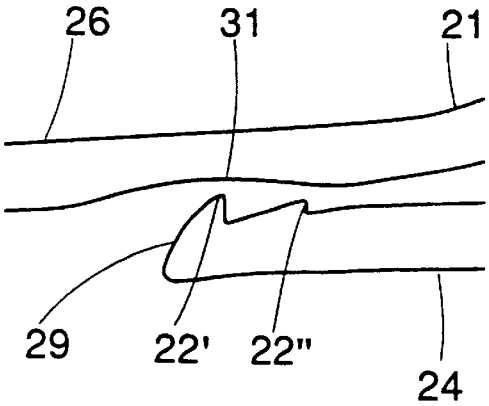
FIG. 4*a* shows a detail of FIG. 4 on an enlarged scale.

FIG. 4*a* shows, on enlarged scale, a detail of a preferred form of a gripping surface, formed by teeth 22', 22", and the facing recess 31 of the device of FIG. 4. As shown, the gripping surface comprises an external prominent tooth 22' in extension of the rounded section 29, and a smaller, slightly recessed inner tooth 22". These two teeth 22', 22" each have a profile designed to facilitate insertion of a page, between the teeth and the facing recess 31, while restraining removal of a gripped page. At the beginning of reading, as illustrated in FIG. 1, the prominent tooth 22 acts to grip the device firmly on the book. When a greater number of pages have been gripped as illustrated in FIG. 2, the opening of arm 24 relative to arm 21 brings the more-recessed inner tooth 22" into action to grip the device on the book.

The angle of the free end of the larger arched section 21 of the clip can be adjusted relative to the short arm 24. As shown in FIGS. 4 and 4*a*, in the "closed" position of the clip, the free end of section 21 is preferably approximately parallel to the short arm 24. This arched design encourages the uppermost clipped page (looking at FIGS. 1 and 2) to fit closely under the short arm 24. When, as usual, this short arm 24 is transparent, this arrangement minimizes text distortion when reading the top page looking through the transparent arm 24.

Figure 5:
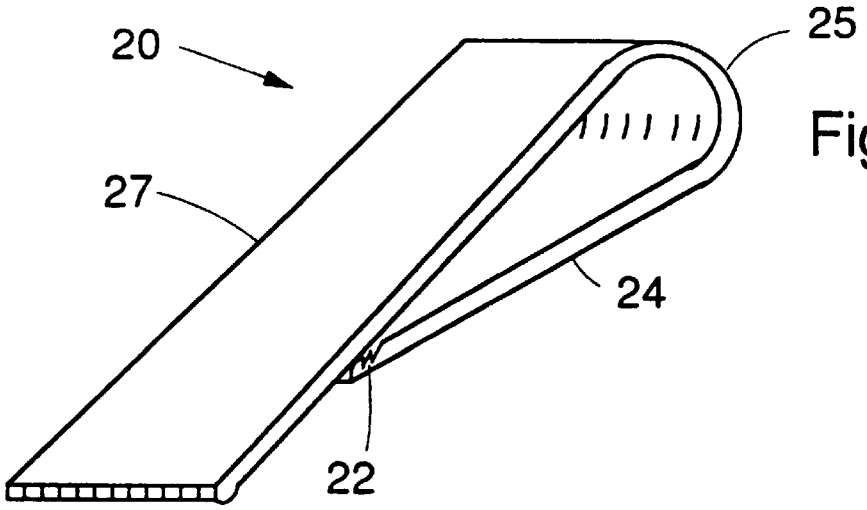
FIGS. 5 to 7 are perspective views showing several alternative embodiments of the device according to the invention.

FIG. 5 shows a similar device 20 but with a flat long arm 27 which will also arch the page.

Figure 6:
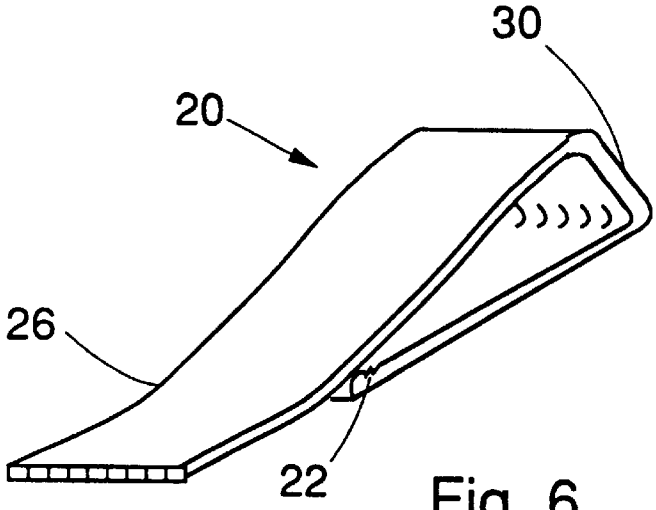

FIG. 6 shows a similar device 20 but with an angulated connecting part 30.

Figure 7:
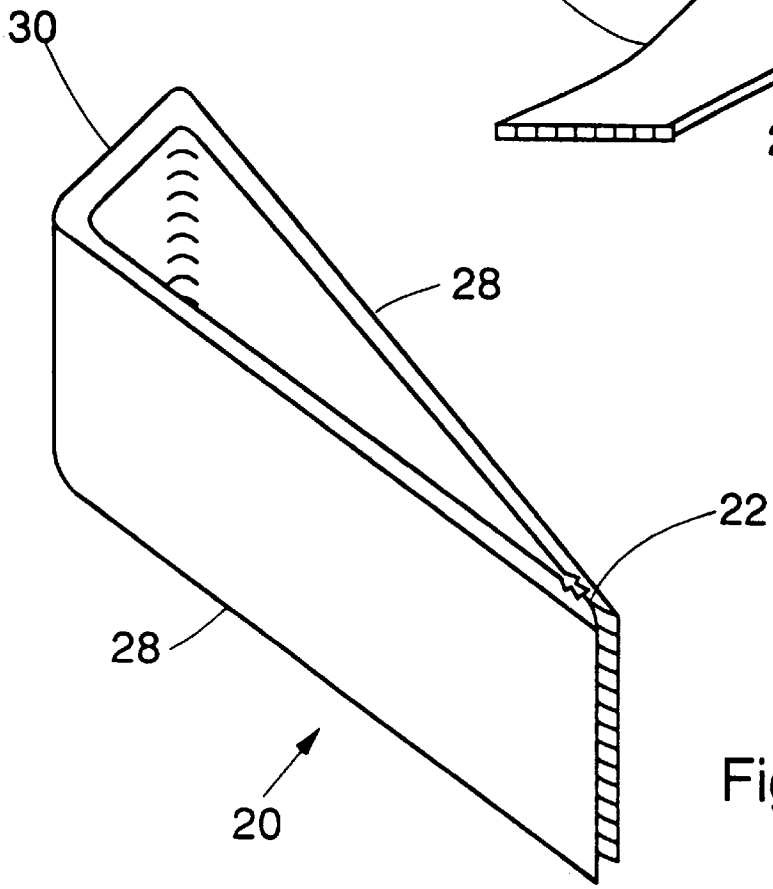

FIG. 7 shows a clip member 20 with equal arms 28 connected by an angulated connecting part 30. This embodiment can be entirely symmetrical, with complementary gripping surfaces 22 on the opposing faces of both ends of the arms, or it can be asymmetrical, by having the arms at different angles to the connecting part 30 or by having a gripping surface 22 on the edge of only one arm, etc.

The arms 21, 24, 27, 28 of the U-shaped or rounded clip member 20 are normally rectangular and of uniform width, and of uniform or varying thickness. A width of about 1.5 to 3.5 cm is convenient, usually about 2 to 3 cm, with a thickness ranging from 1.5, up to about 3 or 4 mm or more for an enlarged/reinforced joining part 25 or 26 which provides the extra counterbalancing weight necessary. The connecting parts 25, 30 usually but not necessarily have the same width. For the most part, the arms will conveniently be of the order of 2 mm thick, possibly flaring out adjacent an enlarged joining part. The longer arm may taper towards the free end. The end of the shorter arm, where the page is inserted, may be thicker or reinforced. The arms (or the longest arm in the case of FIGS. 4 to 6) are usually at least 2.5 times as long as the width, often about 3 or 4 times as long, though this is not a strict requirement.

Hardback, standard paperback, and larger or smaller paperback books, as well as other documents, such as spiral-bound volumes, are all accommodated by the same device. The maximum thickness of the facing arms, adjacent to the joining part, is from about ¼ the width, up to about the same width as the arms, or possibly slightly more. This thickness determines the maximum number of the collection of pages that can be gripped at any time, while retaining the ability to easily close and store the book or other document.

I claim:

1. A book clasping and page marking device useful as a reading aid for keeping a book open while reading, consisting of a folded over clip-like member of resilient material having opposing arms connected by a joining part, the opposing arms having a maximum spacing therebetween adjacent to their joining part and having facing contacting parts at least one of which has a page gripping surface which is serrated, grooved, roughened or otherwise treated or coated to grip the device against a page when the device is clipped on a book, said gripping surface being adapted, by resilient bending apart of the arms, to grip a top inserted page of a number of inserted pages while allowing the device to be slid in or out, and to be able to hold the clip-like member in a protruding position, wherein:

A) adjacent the joining part where their spacing is maximum, the opposing arms are progressively inclined towards one another in spaced apart configuration until an end part of one arm resiliently contacts the other arm, when the clip-like member is in a rest state;

B) the resilient bending apart of the arms about the joining part is such as to allow insertion of a substantial number of pages equivalent to a thickness of paper equal to the maximum spacing of the arms at the joining part;

C) said gripping surface acts to grip the top page of any number of inserted pages, while allowing the insertion of new pages without de-installing and re-installing the device; and D) the joining part of the folded over clip-like member is enlarged or made heavier relative to the opposing arms to provide a counterbalancing effect to help keep the book open when the clip-like member is held in a selected protruding position.

2. The device of claim 1, wherein the opposing arms are flat in cross-section, one arm of the device being generally flat in longitudinal section, and the facing arm being curved in longitudinal section, arched away from the flat arm for the purpose of holding the page being read close to the flat arm.

3. The device of claim 1, wherein the folded over clip-like member has unequal arms, the end part of the short arm having a page gripping surface facing an intermediate part of the longer arm.

4. The device of claim 3, wherein the shorter arm is flat in longitudinal section and the longer arm is arched away from the shorter arm with its end substantially in extension of the shorter arm, serving to arch the book into the open position and hold the page being read against this flat shorter arm.

5. The device of claim 13, wherein the folded over clip-like member has facing arms of equal length which are flat or curved in longitudinal section, with the gripping surface being adjacent to the free end of one or both arms.

6. The device of claim 1, wherein the joining part of the folded over clip-like member is rounded.

7. The device of claim 1, wherein the joining part of the folded over clip-like member is angulated.

8. The device of claim 1, wherein the folded over clip-like member is made of transparent molded plastics material.

9. The device of claim 13, wherein one arm has a gripping surface and the other arm has a corresponding recess facing the gripping surface, in which the gripping surface is received when the arms are fully closed together.

10. The device of claim 1, wherein the gripping surface of the arm has a profile designed to ease insertion of pages into the device and to restrain removal of pages from the device.

11. The device of claim 1, wherein an inside part of the free end of at least one of said arms has a rounded section which flares outwardly to facilitate the insertion of pages between the arms.

12. The device of claim 1, wherein the arms of the folded over clip-like member are of substantially uniform width, at least one arm being at least 2.5 times as long as its width, and the maximum thickness between the facing arms, adjacent the joining part, is from about ¼ the width of the arms up to about the width of the arms.

* * * * *